United States Patent [19]

Lascelles

[11] 4,145,157

[45] Mar. 20, 1979

[54] MODULAR DRAIN FIELD SECTION

[76] Inventor: Daniel J. Lascelles, 744 Lake Winnemissett Dr., Deland, Fla. 32720

[21] Appl. No.: 822,789

[22] Filed: Aug. 8, 1977

[51] Int. Cl.[2] ..... E02B 13/00

[52] U.S. Cl. ..... 405/43; 405/48

[58] Field of Search ..... 61/10, 11, 13, 12

[56] References Cited

U.S. PATENT DOCUMENTS

| | | | |
|---|---|---|---|
| 1,078,635 | 11/1913 | Naylor | 61/13 |
| 1,078,636 | 11/1913 | Naylor | 61/13 |
| 3,080,124 | 3/1963 | Rathmann | 61/13 X |
| 3,220,194 | 11/1965 | Lienard | 61/13 |
| 3,563,039 | 2/1971 | Olsen | 61/11 |

*Primary Examiner*—Mervin Stein
*Assistant Examiner*—David H. Corbin
*Attorney, Agent, or Firm*—Duckworth, Hobby, Allen & Pettis

[57] ABSTRACT

A modular drain field section and a method for making a drain field section are disclosed having upper and lower casings which are connected together to form each drain field section. Both upper and lower casings have a center pipe portion which, when connected together, forms a central pipe and each casing has troughs on both sides of the center pipe portion. The lower casing troughs have a plurality of openings therein and a spillway connects the central pipe with the lower casing troughs. The modular drain field sections are connected together to form a drain field without the use of rock media, fill, drain tile, grace board or felt paper. A method of making the modular drain field section includes using the same mold both for the upper and lower casings.

4 Claims, 5 Drawing Figures

MODULAR DRAIN FIELD SECTION

BACKGROUND OF THE INVENTION

The present invention relates to modular drain field sections which are connected together to form the lateral lines of a drain field to eliminate the need for grading boards fill media, drain tile and felt paper, and to provide a system that may be easily installed by an untrained individual.

In the past, it has been typical to provide sewage disposal systems for individual homes or other buildings located outside of areas serviced by community sewage treatment systems. The typical sewage disposal system connects the building sewage and drain lines to a septic tank which normally includes entrapment of floating solids and settling of other solids which are degraded in the septic tank by micro-organisms. The effluent having a substantial portion of the solids removed is then fed through a sewage line from the septic tank to a distribution box which distributes the fluid through a plurality of parallel lateral lines, which form the drainage field. The lateral lines typically are made of loosely connected tiles which may have perforations therein so that the effluent can seep from the tiles. The tiles are placed on several feet of rock media so that the fluid can easily drain from the tile and percolate into the soil. In addition, the system is generally mounted in the trench on grade boards and is covered with a building paper for the width of the trench.

A number of systems have been proposed for improving drain tiles and also for making improved lateral lines for use in sewage systems. The present invention provides a modular drain field section in which a plurality of drain field sections can be connected to form the lateral lines for the drain field and eliminating the rock media, grade boards and felt in making the system easily adapted for installation by the home user who can dig trenches and connect a plurality of drain field sections to form the drain field. The drain field sections are made of selected polymer materials.

SUMMARY OF THE INVENTION

A modular drain field section and a method of making a modular drain field section are provided in which the drain field section is made up of connected upper and lower casings with the upper casing having a center pipe portion and a trough on either side of the center pipe portion. A lower casing also has a similar center pipe portion and a trough on either side thereof. The two sections fit together to form a completed central pipe with drainage cavities on either side. The lower casing has a plurality of openings for fluid to pass through in addition to small spillways connecting troughs with the center pipe. Each drain field section includes means for the connection of other drain field sections. The upper and lower pipe portions have matching ridges and grooves along each edge thereof for use in connecting the upper and lower casing to form a central pipe therethrough. A method for making a modular drain field section is provided in which the upper and lower casings are each molded of a polymer material in the same mold but with the lower casing having openings in the troughs and the upper casing without openings.

One side of the central pipe portion of both upper and lower casings has a groove and one side has a ridge formed therein with the casings otherwise being symmetrical. One casing is reversed relative to the other so that the ridge along the edge of one central pipe portion fits in the groove of the other casing portion for connecting the casings together and sealing between the central pipe and drainage cavities.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
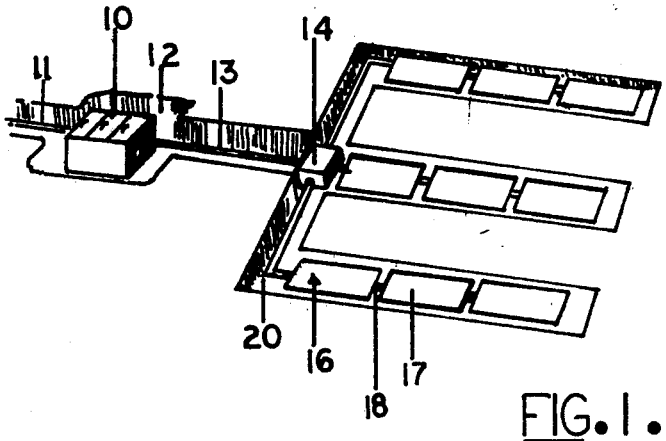
FIG. 1 is a perspective view of a sewage disposal system using the modular drain field sections of the present invention.

Referring now to the drawings and especially to FIG. 1, a septic tank 10 is illustrated connected to a building sewage line 11 and located in the earth 12. A connecting sewage line 13 connects the septic tank 10 to a distribution box 14 which distributes the effluent through a plurality of lines 15 to the laterals 16 of a sewage drain field made up of a plurality of modular drain field sections 17 connected by short sections of pipe 18. As can be seen by this view, the modular drain field sections 16 are placed in a trench 20 without having to use rock and gravel, grade boards, and building paper and without having to connect a large number of drainage tiles together. Thus, the system as illustrated in FIG. 1 can be installed by digging the necessary trenches and connecting the pipes 15 to nine modular drain field sections 16 which are interconnected by short polymer pipes 18. The trench 20 can then be filled in and the drain field is completed.

Figure 2:
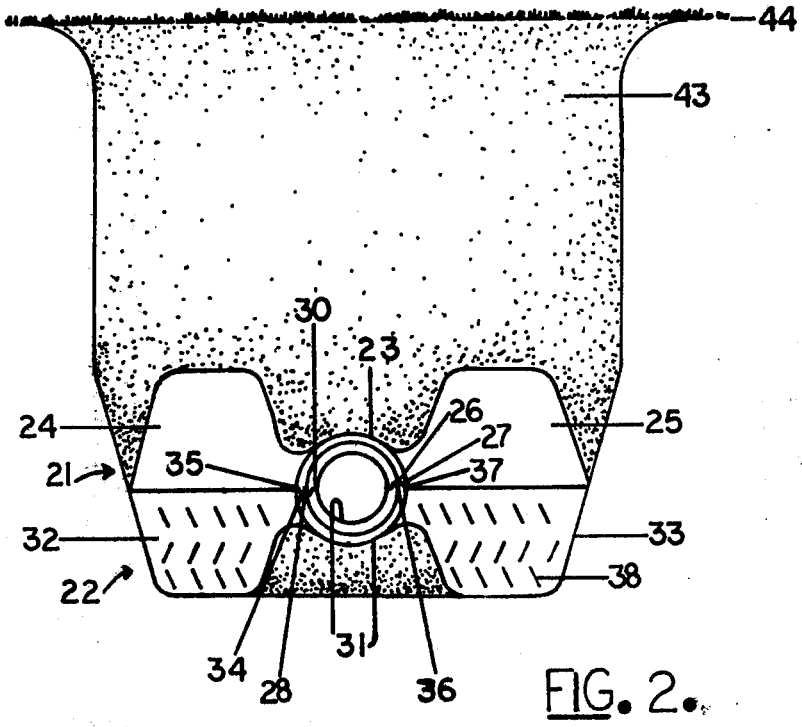
FIG. 2 is a sectional view of a modular drain field section in accordance with the present invention located in a trench.
Figure 3:
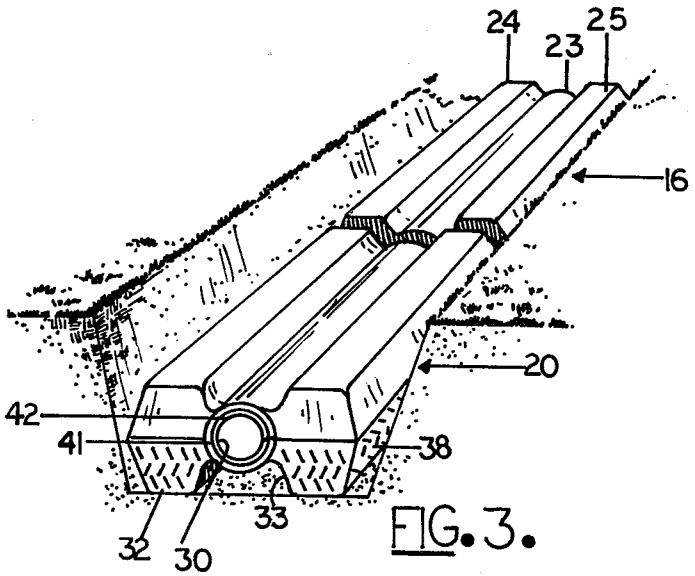
FIG. 3 is a perspective view of a portion of a drain field utilizing the present modular drain field sections prior to filling the trench.
Figure 4:
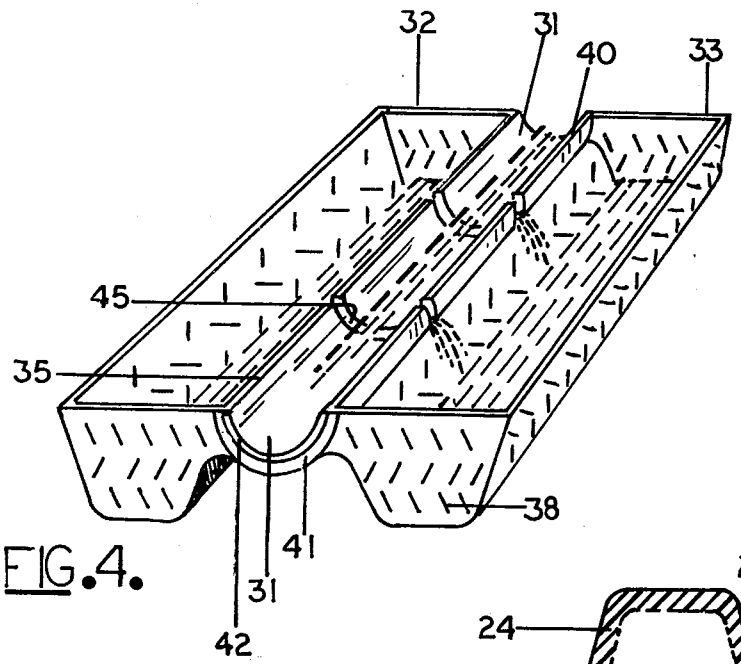
FIG. 4 is a perspective view of the lower casing of the present invention.
Figure 5:
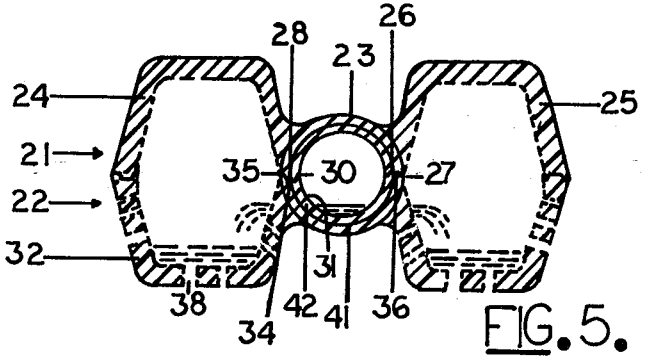
FIG. 5 is a sectional view through one modular drain field section.

FIGS. 2 through 5 more clearly illustrate the modular drain field section having an upper casing 21 and a lower casing 22 connected together to form the drain field section. The upper section has a center pipe portion 23 and a pair of hollow troughs 24 and 25 connected to and formed as part of the central pipe section 23. The upper drain field section central pipe portion 23 has an elongated groove 26 running along its edge 27 on one side and an elongated ridge or rib 28 running along the other elongated edge 30. The lower drain field section is substantially identical to the upper section, having a central pipe portion 31 with a pair of troughs 32 and 33 connected thereto. The lower section has a groove 34 along the edge 35 and a ridge 36 along the edge 37 located on opposite sides from the central pipe section 23 of the upper drain field section 21. The lower drain field section also has a plurality of openings 38 located in a spaced relationship to each other over the surface of the troughs 32 and 33. The lower drain field sections also have a plurality of spillways 40 connecting the pipe section 31 with the troughs 32 and 33, as more clearly illustrated in FIG. 4. In addition, upper and lower sections both have their central pipe sections 23 and 31 having a protruding end 41 with an annular recessed ledge 42 to allow a connecting pipe section to be slid therein to abut ledge 42 for attaching the drain field sections together. The drain field section of FIG. 2 is illustrated in place covered with earth 43 which may have grass 44 growing thereover. In addition, each of the spillways 40 of the lower casing 22 have ridges 45 located therein for directing fluids passing through the pipes into the spillways 40 so that as the fluids flow through the central pipe passing through a plurality of drain field sections 16, the fluid will be directed into each section troughs 32 and 33 rather than the effluent rushing to the last most drain field section which then fills and backs up to the next, and so forth. This allows more even distribution of the effluent in the drain field.

The present drain fields may advantageously be made of a polymer such as expanded poly styrene beads which may be molded for mass production and which is resistant to degradation by the sewage effluent and chemical normally found in drainage lines. In addition, the upper casing 21 and the lower casing 22 are identical except for the openings in the lower casing and may be made from the same mold but with the portions forming the openings 38, removed or blanked out for the making of the upper casing 21. The upper casing is then reversed relative to the lower casing, so that the lower casing groove 28 and ridge 36 on central pipe 31 will match the ridge 35 and grooves 26 of the upper section. The sections are then attached together with an adhesive to form one integral modular field section which may be purchased from a building supply dealer or the like, along with the connecting pipe portions.

The method of making the present invention is performed by molding a plurality of lower casings having the openings 38, then modifying the mold to retract the core pins forming the openings 38 until the core pins are flush with the interior mold surface, thereby providing a mold without core pins, then molding a plurality of identical sections in the same mold without the openings 38. One upper casing 21 is then positioned adjacent one lower casing 22 but in a reverse direction from which upper casing and lower casing 22 were molded. An adhesive is applied to the section edges which are pressed together to form one complete unit having pair of drainage cavities and a central pipe. The core pins are for each trough section and are mounted to a base and thereby retracted together. The interconnecting grooves and ridges form a more secure connection between upper casing 21 and lower casing 22 with a better seal between the central pipe and the drainage cavities. This method advantageously reduces the cost of manufacture by use of the same mold and thereby assuring identical fits between upper and lower casings and a stronger connection between the upper and lower casings.

It should be clear at this point that a modular drain field section has been provided for the installation of a waste disposal system drain field which is adapted for installation by the layman as well as a more rapid installation by construction companies without the necessity of hauling large amounts of gravel and rock and other building materials for the installation of the drainage field. It should also be clear that the present invention is not intended to be limited to the particular forms as shown herein, which are considered illustrative rather than restrictive.

I claim:

1. A modular drain field section comprising in combination:

an elongated molded polymer upper casing formed in one piece and having a center pipe portion and a pair of troughs, one on each side thereof;

an elongated molded polymer lower casing formed in one piece having a center pipe portion and a pair of troughs, one on each side thereof, each side trough having a plurality of openings therein and said central pipe portion having a plurality of spillways formed therein connecting said pipe portion to each trough;

said upper and lower casings being adhesively connected together to form a central pipe with enclosed drain cavities on either side thereof;

connecting means located on each end of said central pipe, said connecting means having an annular rim formed on the end of each central pipe portion of said modular drain field section for attaching sections of polymer pipe thereto, said modular drain field section connected upper and lower casings forming a central pipe circular in cross-section having spillway openings therein opening into enlarged cavities on either side forming a pontoon configuration, whereby a plurality of modular drain fields can have their central pipe connected together for liquid to flow through into said drainage cavity to form a drain field.

2. The apparatus in accordance with claim 1, in which said upper casing center pipe portion has an elongated groove along one edge thereof and an elongated ridge along the other edge thereof and said lower casing center pipe portion has an elongated ridge on one edge thereof, and an elongated groove on the other edge thereof, whereby said upper and lower casing center pipe portions can be connected with each ridge on one casing fitting into a groove on the other casing whereby a more secure connection is provided to form said central pipe.

3. The apparatus in accordance with claim 2, in which said lower casing plurality of openings includes a plurality of slots located in a spaced relationship to each other to allow drainage of fluid therethrough.

4. The apparatus in accordance with claim 3, in which said upper and lower casings are made of expanded poly styrene beads.

* * * * *